US006980767B1

(12) United States Patent
Cahill et al.

(10) Patent No.: US 6,980,767 B1
(45) Date of Patent: Dec. 27, 2005

(54) METHOD AND APPARATUS FOR ADHERING SHEETS OF PRINT MEDIA TOGETHER BY USE OF TONER IN AN ELECTROPHOTOGRAPHIC PRINTER

(75) Inventors: Daniel P. Cahill, Verona, KY (US); David L. Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/986,334

(22) Filed: Nov. 11, 2004

(51) Int. Cl.[7] ..... G03G 15/00

(52) U.S. Cl. ..... 399/408; 399/400; 399/407; 400/605

(58) Field of Search ..... 399/407, 408, 399/410, 400; 493/187, 264; 400/605

(56) References Cited

U.S. PATENT DOCUMENTS 4,398,986 A 8/1983 Smith, Jr. et al.
5,021,273 A * 6/1991 Kobayashi ..... 428/42.1
5,213,560 A 5/1993 Crowley
5,350,268 A * 9/1994 Muller ..... 412/1
5,582,570 A 12/1996 Crowley
6,439,820 B1 * 8/2002 Lehner et al. ..... 412/4
6,681,097 B2 * 1/2004 Kimura et al. ..... 399/405

* cited by examiner

*Primary Examiner*—Daniel J. Colilla
*Assistant Examiner*—Dave A. Ghatt
(74) *Attorney, Agent, or Firm*—Fredrick H. Gribbell, LLC

(57) ABSTRACT

An improved electrophotographic printer is provided for printing on sheet media, and for joining two or more sheets of sheet media together within the print engine. A first sheet can be imaged with "standard" information and/or indicia, and can also have one or more strips of toner applied at predetermined locations. The first sheet is then run back to the print engine while a second (virgin) sheet of print media is picked from an input tray at a time that will cause both sheets to run through the print engine simultaneously, either exactly at the same time, or with some offset spacing. The two sheets will become joined or affixed to one another at locations in which the toner strips are of sufficient size and density, and will be output together as if stapled, or sealed, together.

35 Claims, 5 Drawing Sheets

METHOD AND APPARATUS FOR ADHERING SHEETS OF PRINT MEDIA TOGETHER BY USE OF TONER IN AN ELECTROPHOTOGRAPHIC PRINTER

TECHNICAL FIELD

The present invention relates generally to image forming equipment and is particularly directed to electrophotographic printers of the type which use toner to form images on a sheet of print media. The invention is specifically disclosed as a "virtual stapler" that uses toner to adhere multiple sheets of print media together within the print engine of a laser printer, in which the pattern of toner that is deposited onto one of the sheets of print media determines the strength of such adhesive characteristics that can make up a toner-based virtual staple. In one mode of the invention, two sheets are "fastened" together by one or more strips of toner (or "toner bars") applied to one of the two sheets. After the toner is deposited on the first sheet, that sheet is run back to the print engine while a second virgin sheet is picked from an input tray; both sheets are then run through the print engine, including the fuser, which fuses the toner to both sheets and thus makes the virtual staple.

In another mode of the invention, a first sheet is run through the print engine and then run back to the print engine while a second virgin sheet is picked from an input tray. Either the first sheet or the second sheet can receive a strip of toner near one of its leading or trailing edges, and both sheets are then run through the fuser. The orientation of the two sheets and the toner strip are such that the two sheets are offset by nearly the length of one of the sheets in the direction of its movement through the paper pathway. After being fused together, the two separates sheets of a first length become a single longer sheet, and thus form a "banner" that can be output as one continuous piece of material. The two sheets can also be printed with user-determined information or indicia, either before being fused together, or the joined sheets can be run back to the print engine after being joined to then be printed with such user-determined information or indicia. A third sheet (and more) can be similarly joined, to make the banner even longer, if desired, by applying toner to either the trailing edge of the second sheet or the leading edge of the third sheet.

In yet another mode of the invention, a confidential "mailing" paper can be constructed within an EP printer, by printing information and strips of toner on a first sheet, then running it back to the print engine while a second virgin sheet is picked from an input tray. The second sheet will become joined ("affixed" or "adhered" or "bonded") to the first sheet at locations where there is sufficient toner to form such a joint or bond. The locations of the toner-made joints/bonds are selected to essentially provide a seal around the confidential information that is printed on the first sheet. An address and postage can also be printed thereon (either onto the first sheet's reverse side, or onto the second sheet), thereby finishing the confidential mailing automatically. The address can thus be guaranteed to be correctly matched to the printed information (e.g., for bank statements, tax statements, and the like), since the information and address are part of the same print job for this mailing.

In the present invention, when a sheet of print media is to be "run back to the print engine," it can be sent through a standard duplexer unit twice, to flip it two times so that it is oriented with its original top side up at the time it is joined to the second sheet. Alternatively, the sheet can be sent a single time through a modified duplexer unit that includes a movable deflector which, when actuated, will cause the sheet to run directly through the duplexer without being flipped. Of course, this modified duplexer would save some "print and seal" processing time when joining two or more sheets of print media together within the print engine, according to the present invention.

BACKGROUND OF THE INVENTION

In many prior situations, multiple sheets of paper have been mechanically fastened together by use of a metal staple or a plastic staple, or by a paper clip, or perhaps by gluing the sheets together. This required an additional operation after the document left a printer apparatus. In addition, the mechanical fastening devices made recycling of the sheet media difficult, due to the presence of these mechanical fastening devices.

In the past, many confidential mailings contained documents such as tax forms, bank statements, insurance statements, medical information, etc. They were typically handled by printing the statement and folding it so that the confidential information becomes located on the interior folded surfaces, and then the statement would be stuffed into an envelope; in that manner the printed information would not be easily seen through the envelope. A second handling method was to print this type of confidential information on forms that were pre-sealed on the edges so that, once delivered to the customer, the form was opened by tearing one or more edges along a perforated line. The forms would then be peeled apart to expose the confidential information. Many types of pre-sealed forms used pressure sensitive paper on one side to record the confidential information between the two sheets of paper. This typically would require a dot matrix printer, or some other type of mechanical impact printing method.

In U.S. Pat. No. 5,213,560, a method for manufacturing sealed envelopes is disclosed, mainly to describe one-piece mailers that can be folded upon themselves and sealed by use of toner strips. The sheet can be provided with printed text, along with the strips of toner of various printing patterns. The toner strips are subsequently heated and the sheet is folded so that the toner strips overlap a folded section of the sheet. Toner is sealed using heat and pressure to create a completed, sealed envelope or package. In one example, a paper web is directed through a printing device, then through a preheat device to soften the strips of toner along the side edges of the paper web. The paper web is then cut into individual sheets, such as letter-sized sheets of paper. After this cut is made, the sheet is folded upon itself, such that the side toner strips come into contact with one another because the side toner strips on the top half of the folded sheet are placed against those on the bottom half of the same folded sheet. This folded sheet is then run through another heating station, at which time the face-to-face toner strips are heated and become bonded to one another, thereby securing the folded paper in a configuration that is sealed along those edges. The opposing (face-to-face) toner strips are placed on each paper surface, and provide a secure bond when they are heated or melted together. This patent discusses the possibility of applying toner to only one side of the paper, however the bond achieved with only a one-sided toner strip is considered generally weaker than two opposing toner strips. On the other hand, a one-sided toner strip can hold the two pieces of paper together until they are to be opened later, at which time the one-sided strip can be removably detached from the other "plain" paper side of the folded mailer. This patent discusses an alternative mode where a printer capable of printing on both sides of a sheet could be used to establish a toner-to-toner joint. This patent also can vary the strip pattern so that it is not necessarily a solid bar of toner. If the strip pattern is varied, the toner density will also be varied, and thus the adhesive strength will be varied. Another alternative is to use opposing cross-hatchings that have sets of lines with unprinted parts of overlapping surfaces. This will result in a somewhat firm, but detachable joint. In yet another embodiment, a relatively solid bar of toner is placed into contact with a group of spaced-apart dots. The density of the dots will then control the adhesive strength of this bond. Another embodiment uses diagonal slashes of toner that are placed into overlapping contact with one another when the sheet is folded and heated. Still another embodiment uses dots of toner around an address window that is to be part of the mailer sheet media. This prevents a person from looking inside the envelope around the clear address window.

U.S. Pat. No. 4,398,986 discloses a binding method that uses re-fusable xerographic toner along an edge of multiple copy sheets, which can be then bound into booklets by arranging the sheets in a stack and re-fusing the toner so that the re-fused toner adheres the adjacent sheets together. This re-fusing operation can be performed after a group of a few sheets is received from a copier, so that the finishing operation can be carried on at the same rate as the copies that are produced by the copier. Alternatively, a larger stack of sheets can be bound together in an off-line operation by a simple heating step. In this patent, a series of rows of alternating rectangular toner strips are placed along the left-hand edge of each of these sheets. A heating shoe is used to press down against the sheets that are to be bonded together with other sheets in the stack. The heating shoe has a movable heating bar that has an elongated surface with a pattern of raised portions and recessed portions. The raised portions have the appearance of small rectangles or ovals. Heat is transmitted from the raised portions to the toner strips of the elongated continuous toner strips on the paper. The recessed portions are located below the level of the raised portions, and will not make contact with the paper that is being bonded to adjacent papers in the stack. The heating shoe is brought against the sheets in the stack with pressure, so that both pressure and temperature are used to bond the toner to the adjacent sheets in the stack. This binding operation can be used for single-sided copies, or for duplex (two-sided) copies that have information copied on both faces of the sheet.

U.S. Pat. No. 5,582,570 discloses a method for binding sheets together using a reactivatable printing substance such as toner along a binding edge of a sheet. Printed text can be simultaneously applied to the sheet by the printing device. Two separate strips of toner placement are available along the edge of the sheet, and as each first sheet is overlaid by a second sheet, the toner strip on the preceding sheet is fused to the uppermost sheet by a strip of toner that is facing downward, thereby binding the sheets together when they are heated. Then the topmost sheet can be printed again (on its other side) with a strip of toner at a different location, with respect to the edge of the sheets that are being bound together. A third sheet can be printed with toner, and then the third sheet is placed so that its toner strip is facing downward, adjacent to the toner strip on the second sheet that is now facing upward. This combination of sheets is then fused together. This can continue for many sheets. A movable heated platen can be rolled along either one of the strip placements, such that the platen presses down against the uppermost sheet at a location where toner is facing downward, but not upward, on that sheet. Then if another sheet is placed thereupon, the movable rolling platen will be rolled along an adjacent strip location to press down against the topmost sheet at placements having toner facing downward, but not upward. In this manner, the platen never touches an upward-facing toner strip. This patent also describes an alternative method of attaching sheets together using alternating rectangles of toner along the same strip. In this alternative embodiment, there are several adjacent rectangles of placement areas that can position toner on the sheet, in which the "even page" placements for these toner rectangles are at different locations than the "odd page" toner placements. When two sheets are to be sealed together, they would use only one set of these toner patch placements, and a platen having one or more rectangular surfaces would press down on the uppermost sheet at locations where the toner is facing only downward. If another sheet is to be overlaid on top of the uppermost sheet at this time, then the odd page rectangles of toner can be used, and the platen can be moved so that it touches the uppermost sheet at only the odd page locations, where toner is not facing upward on that uppermost sheet. The main object of this invention is to allow any sized stack of sheets to be fused together, in a manner that does not require multiple layers to be fused at one time, which can cause uneven heating for different layers of the toner strips. Instead, this patent allows only the uppermost two sheets to be fused at one time, thereby guaranteeing that these uppermost two sheets will receive sufficient heat energy to create a strong bond of toner between the sheets. The lower sheets in the stack were already fused together before each new fusing operation.

Some of the earlier patents that disclose use of toner to bind sheets together are somewhat limited, in that they require a special size or shaped platen to be used, and moreover, the platen must be movable, either in its X-Y positioning on the sheet as it is pressed down against the sheet, or such that it actually moves (rolls) along the surface of the sheet. Others of the earlier patents use a continuous web of paper, rather than individual sheets, and a paper cutting step must be performed. In addition, the cut paper sheet must then be folded so that the toner from one side of the sheet comes into contact with toner (or paper) from the other side of the sheet; thus a folding operation must be performed to complete the sealed package.

Accordingly, it would be an improvement to provide a method and apparatus that can bind two or more sheets together using toner inside a printer, solely by having the two sheets simultaneously pass through the fuser of a standard EP printer or laser printer, without the need for a folding step and without the need for a movable platen for applying heat and pressure, and with complete freedom as to the exact placement of the toner strips that are to bind the sheets together.

SUMMARY OF THE INVENTION

Accordingly, it is an advantage of the present invention to bind two or more sheets of print media together in a printer without the need for a mechanical binding device, by use of a virtual staple.

It is another advantage of the present invention to bind two or more sheets together in a printer in a manner that can customize the sheet-to-sheet bond (joining) strength.

It is yet another advantage of the present invention to provide the ability to bind two or more sheets of print media together in a manner that can have a customized virtual staple pattern.

It is still another advantage of the present invention to provide the ability to bind two or more sheets together in a printer in a manner that can offset or shingle the sheets by use of the virtual staples.

It is a further advantage of the present invention to provide the ability to bind two or more sheets of print media together to increase the overall length of the output sheet, so as to create a lengthy "banner" sized printed sheet.

It is a yet further advantage of the present invention to provide the ability to send confidential information on a sheet of print media without the time consuming burden of folding, stuffing, and sealing envelopes.

It is a still further advantage of the present invention to provide the ability to send confidential information on print media in a manner that automatically addresses the envelopes, and guarantees that the name and address on the sealed sheets will match the name for whom the confidential information is contained therein.

It is still another advantage of the present invention to provide the ability to send confidential information by sealing two sheets of print media together within a printer, in which one of these sheets has a pre-printed pattern that covers the confidential information, thereby increasing its confidentiality.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a method for printing and joining at least two sheets of print media in an image forming apparatus is provided, in which the method comprises the following steps: (a) providing an image forming apparatus having a print media input device, a print engine that applies and affixes image-forming material to the print media at an image-forming station and at an image-fixing station, a first output pathway that re-directs the print media back to the print engine, and a second output pathway that directs the print media to an output area; (b) moving a first sheet of the print media from the print media input device to the print engine, and, according to user print data, applying the image-forming material to a first surface of the first sheet at the image-forming station, including to at least one predetermined affixing area of the first surface of the first sheet; (c) moving the first sheet through the first output pathway, and back to the print engine; (d) moving a second sheet of the print media from the print media input device to the print engine in a manner such that the second sheet overlaps at least a portion of the first sheet, the portion including the at least one predetermined affixing area, wherein the first surface of the first sheet is facing toward the second sheet; (e) at the image-fixing station, joining both the first sheet and the second sheet to the image-forming material at the at least one predetermined affixing area, thereby joining the first and second sheets together as combined sheets of print media; and (f) thereafter, moving the combined sheets of print media through the second output pathway to the output area.

In accordance with another aspect of the present invention, a method for printing and joining at least three sheets of print media in an image forming apparatus is provided, in which the method comprises the following steps: (a) providing an image forming apparatus having a print media input device, a print engine that applies and affixes image-forming material to the print media at an image-forming station and at an image-fixing station, a first output pathway that re-directs the print media back to the print engine, and a second output pathway that directs the print media to an output area; (b) moving a first sheet of the print media from the print media input device to the print engine, and, if called for by user print data, applying the image-forming material to a surface of the first sheet at the image-forming station; (c) moving the first sheet through the first output pathway, and back to the print engine; (d) moving a second sheet of the print media from the print media input device to the print engine in a manner such that the second sheet overlaps at least a portion of the first sheet at a first predetermined affixing area, and, if called for by user print data, applying the image-forming material to a surface of the second sheet at the image-forming station; (e) wherein, the user print data includes applying the image-forming material to at least one of the surfaces of the first and second sheets within the first predetermined affixing area, and at the image-fixing station, joining both the first sheet and the second sheet to the image-forming material at the first predetermined affixing area, thereby joining the first and second sheets together as a first set of combined sheets of print media; (f) thereafter, moving the first set of combined sheets of print media through the first output pathway and back to the print engine; (g) moving a third sheet of the print media from the print media input device to the print engine in a manner such that the third sheet overlaps at least a portion of the first set of combined sheets at a second predetermined affixing area, and, if called for by user print data, applying the image-forming material to a surface of the third sheet at the image-forming station; (h) wherein, the user print data includes applying the image-forming material to at least one of the surfaces of the second and third sheets within the second predetermined affixing area, and at the image-fixing station, joining both the second sheet and the third sheet to the image-forming material at the second predetermined affixing area, thereby joining the second and third sheets together as a second set of combined sheets of print media, which now includes all of the first, second, and third sheets; and (i) thereafter, moving the second set of combined sheets of print media through one of: (1) the first output pathway and back to the print engine, and (2) the second output pathway to the output area.

In accordance with a further aspect of the present invention, a method for printing and joining at least three sheets of print media in an image forming apparatus is provided, in which the method comprises the following steps: (a) providing an image forming apparatus having a print media input device, a print engine that applies and affixes image-forming material to the print media at an image-forming station and at an image-fixing station, a first output pathway that re-directs the print media back to the print engine, and a second output pathway that directs the print media to an output area; (b) moving a first sheet of the print media from the print media input device to the print engine, and, if called for by user print data, applying the image-forming material to a surface of the first sheet at the image-forming station; (c) moving the first sheet through the first output pathway, and back to the print engine; (d) moving a second sheet of the print media from the print media input device to the print engine in a manner such that the second sheet precedes the first sheet at the print engine and overlaps at least a portion of the first sheet at a first predetermined affixing area, and, if called for by user print data, applying the image-forming material to a surface of the second sheet at the image-forming station; (e) moving a third sheet of the print media from the print media input device to the print engine in a manner such that the third sheet follows the first sheet at the print engine and overlaps at least a portion of the first sheet at a second predetermined affixing area, and, if called for by user print data, applying the image-forming material to a surface of the third sheet at the image-forming station; (f) wherein, the user print data includes applying the image-forming material to at least one of the surfaces of the first and second sheets within the first predetermined affixing area, and at the image-fixing station, joining both the first sheet and the second sheet to the image-forming material at the first predetermined affixing area, thereby joining the first and second sheets together as a first set of combined sheets of print media; (g) wherein, the user print data includes applying the image-forming material to at least one of the surfaces of the first and third sheets within the second predetermined affixing area, and at the image-fixing station, joining both the first sheet and the third sheet to the image-forming material at the second predetermined affixing area, thereby joining the first and third sheets together as a second set of combined sheets of print media, which now includes all of the first, second, and third sheets; and (i) thereafter, moving the second set of combined sheets of print media through one of: (1) the first output pathway and back to the print engine, and (2) the second output pathway to the output area.

In accordance with yet another aspect of the present invention, a method for printing and joining two sheets of print media in an image forming apparatus is provided, in which the method comprises the following steps: (a) providing an image forming apparatus having a print media input device, a print engine that applies and affixes image-forming material to the print media at an image-forming station and at an image-fixing station, a first output pathway that re-directs the print media back to the print engine, and a second output pathway that directs the print media to an output area; (b) moving a first sheet of the print media from the print media input device to the print engine, and, according to user print data, applying and affixing the image-forming material to a first surface of the first sheet at the image-forming and image-fixing stations, the user print data including a plurality of predetermined security regions; (c) moving the first sheet through the first output pathway, and back to the print engine; (d) moving a second sheet of the print media from the print media input device to the print engine in a manner such that the second sheet overlaps at least a portion of the first sheet, wherein the first surface of the first sheet is facing toward the second sheet; (e) at the image-fixing station, joining both the first sheet and the second sheet to the image-forming material to create security seals at the plurality of predetermined security regions, thereby joining the first and second sheets together as combined sheets of print media; and (f) thereafter, moving the combined sheets of print media through the second output pathway to the output area, thereby producing a document having printed information that is sealed from view, without any folding operation and with no separate heated platen apparatus.

In accordance with still another aspect of the present invention, an image forming apparatus is provided, which comprises: (1) an interface circuit; (2) a print media input device, (3) a print engine that applies and affixes image-forming material to the print media at an image-forming station and at an image-fixing station, a first output pathway that re-directs the print media back to the print engine, and a second output pathway that directs the print media to an output area; wherein: the interface circuit contains input and output devices that are configured: (a) to move a first sheet of print media from the print media input device to the print engine, and, according to user print data, to apply the image-forming material to a first surface of the first sheet at the image-forming station, including to at least one predetermined affixing area of the first surface of the first sheet; (b) to move the first sheet through the first output pathway, and back to the print engine; (c) to move a second sheet of the print media from the print media input device to the print engine in a manner such that the second sheet overlaps at least a portion of the first sheet, the portion including the at least one predetermined affixing area, wherein the first surface of the first sheet is facing toward the second sheet, and to determine a relative position of a leading edge of the first sheet compared to a leading edge of the second sheet as they move through the print engine; (d) at the image-fixing station, to join both the first sheet and the second sheet to the image-forming material at the at least one predetermined affixing area, thereby joining the first and second sheets together as combined sheets of print media; and (e) thereafter, to move the combined sheets of print media through the second output pathway to the output area.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
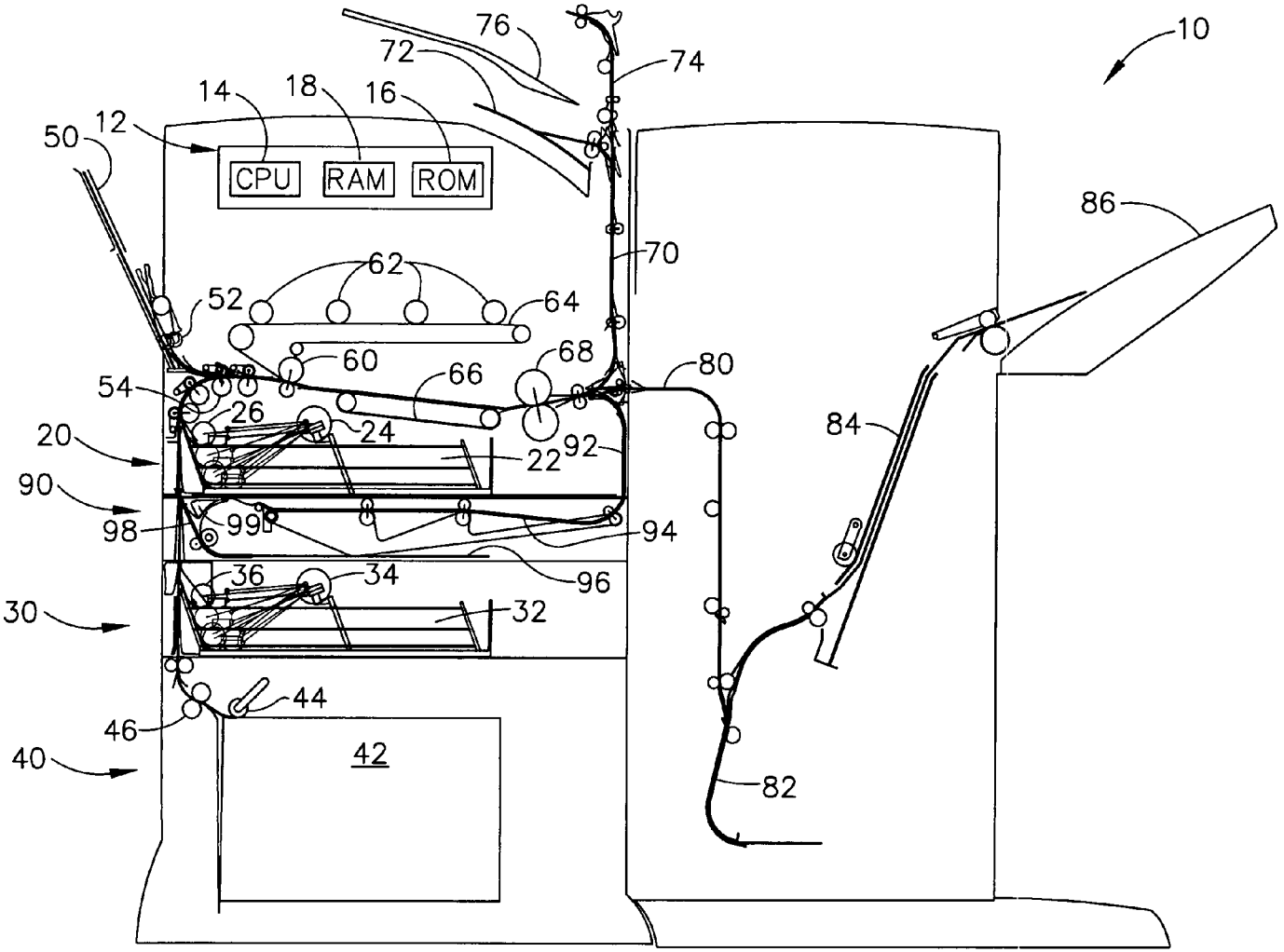
FIG. 1 is a side view in cross-section of the mechanical paper pathways and rollers of a laser printer, as used in the present invention.

Referring now to FIG. 1, an electrophotographic (EP) printer is illustrated in a cross-section side view, and this printer is generally designated by the reference numeral 10. Printer 10 can be a laser printer, such as a Model No. C752, manufactured by Lexmark International, Inc. Printer 10 has an input tray 20, which holds a stack of paper sheets 22, and which includes a pickup motor 24 and a drive roller 26. As seen in FIG. 1, the drive roller 26 lowers as the paper stack 22 diminishes.

On FIG. 1, printer 10 also includes an optional second input tray, generally designated by the reference numeral 30. This second input tray typically holds a stack of paper sheets at 32, and also includes a pickup motor 34 and a drive roller 36, which also has multiple positions. The second input tray 30 might hold a different type of print media than tray 20, such as 8½×11 transparencies, or A4-sized paper.

In a relatively large laser printer such as the Lexmark Model No. C752, an optional "large" input tray can be included, such as the third input tray that is stacked on the bottom of the printer 10 in FIG. 1, generally designated by the reference numeral 40. This large input tray can hold a much larger paper stack at 42, such as 500 sheets or 2000 sheets. Input tray 40 includes a pickup roller 44 and a paper path feed roller set at 46.

Printer 10 can also be provided with a manual feed input tray, which is common in many laser printers. Such a manual feed input tray is generally designated by the reference numeral 50, and can be used to feed alternative types of media, such as envelopes. This manual input tray includes a pickup roller 52, that feeds into a common media pathway that exhibits a number of input path drive rollers at 54. This common pathway leads to a toner transfer nip 60, which is the point where print media receives toner from an intermediate transfer member (ITM), such as the ITM belt 64 on FIG. 1. In essence, this toner transfer nip 60 acts as an image-forming station within the print engine.

Many color laser printers have multiple individual color printing stations that each form a particular color of toner on an intermediate transfer member, and that transfer member then transports all of the colors of the toner to the toner transfer nip (i.e., nip 60), at which time the toner is transferred to the sheet media. In printer 10, there are four (4) separate toner transfer stations, which are illustrated as color print rollers 62. These rollers 62 are merely a portion of a set of four print engines, one per color of toner used in this color laser printer. Of course, in most EP printers the standard four colors are cyan, magenta, yellow, and black. It should be noted that the present invention can certainly be used with monochrome printers, as well as with multi-color printers.

The sheet media is further transported from nip 60 by another belt 66, which transports the sheet media to a fuser station 68, which includes a hot roller and a backup roller (as seen on FIG. 1) that form a nip through which the sheet media passes. At this point, the toner is fused to the sheet media, and the fusing station 68 essentially acts as an image-fixing station. The sheet media now can either be output from the printer through various output pathways, or it can be directed to a duplexer station.

In many EP printers, the output paper path that will be taken by the sheet media after it leaves the fuser will go essentially straight up as seen in this view of FIG. 1. This is the paper path at the reference numeral 70, which then extends off toward the left (as seen in this view) to an output tray 72. A second output tray pathway is also available at 74, which can be used to direct the output sheets to a larger output bin 76. The details of the bin 76 are not shown on FIG. 1; such large bins are well-known in the printing field of technology.

A second output path 80 can take the sheet media to an inverter. The inverter's temporary tray is at 82, which first receives the sheet media from the fuser 68, and temporarily holds the media in tray 82. At the proper time, the sheet media is taken from this inverter tray 82 up through an output pathway and up to a collator tray 84, to be collated and stapled. At the proper time, the sheet media is taken from this collator tray to the output tray 86.

These various output pathways and input pathways are fairly standard in conventional laser printers. Another standard item for more expensive laser printers is a duplexer, which is generally designated by the reference numeral 90 on FIG. 1. In standard duplexers, the sheet media leaves the fuser 68 and is directed down a third output pathway, at reference numeral 92. The sheet media follows along a set of drive rollers through a pathway 94, and then is directed down toward a duplexer reversing tray 96. After a particular piece of sheet media has been placed into the reversing tray 96, it will then be transported back up toward the input pathway, via a duplexer output pathway 98. The sheet is then directed back to the input path drive rollers 54 and then through the toner transfer nip 60. In this manner, the opposite side of the sheet media can be printed automatically by the printer 10.

In the present invention, the duplexer 90 also can be modified so as to allow a piece of sheet media to go directly through the duplexer without having its side reversed. The reason for this will be described below. In that situation, a deflector 99 is used to intercept the sheet media's normal pathway down to the duplexer reversing tray 96. Instead of allowing that to occur, the deflector 99 will change its position and cause the sheet media to pass directly from the duplexer drive roller pathway 94 to the duplexer output pathway 98, at which time it will then be directed back to the input path drive rollers 54 and to the toner transfer nip 60. When that occurs, the sheet will be directed back through the printing transfer station 60 with the same side "up" that was also previously "up" when the sheet passed through earlier.

As in most EP printers or laser printers, there is a controller, generally designated by the reference numeral 12, that typically will control the printing process and the rasterizing process. Controller 12 can also control the movements of the paper sheets through the various paper pathways in printer 10, including the sheets passing through duplexer 90, and controls the precise timing of the starting of a second sheet while a first sheet is also approaching the printing unit at 60.

Controller 12 will typically include some type of processing circuit, such as a microprocessor or microcontroller 14, which typically has at least one address bus, one data bus, and perhaps one control bus or set of control signal lines. Such a laser (or EP) printer 10 also contains memory elements, such as read only memory (ROM) 16 and random access memory (RAM) 18, which also would typically be in communication with an address bus and data bus, and can be connected through these buses to the microprocessor or microcontroller 14.

It should be noted that much of the control logic needed for controlling the functions of the printing process and the sheet media movements of a printer can be off-loaded to a physically separate processing circuit or a virtual processing device. For example, a host computer could send appropriate command signals directly to output switching devices (e.g., transistors or triacs) that reside on the printer main body; the host computer could also directly receive input signals from various sensors on the printer main body, to facilitate the control logic that is resident on such a host computer. Thus the control logic (or a portion thereof) of a printing device need not always be part of the physical printer, but may be resident in another physical device, or perhaps be virtual.

Virtual Stapler

Figure 2:
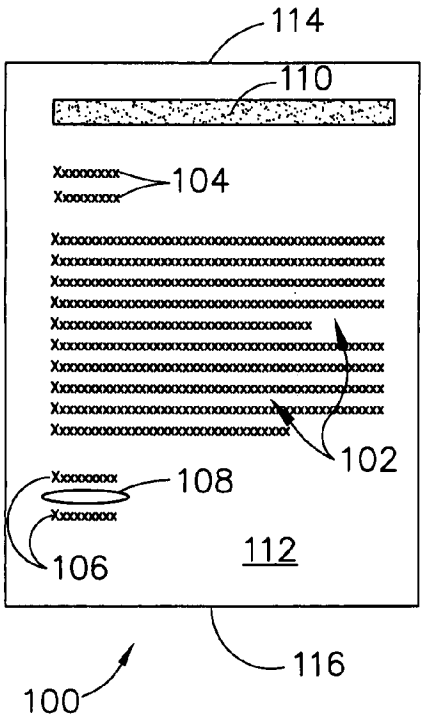
FIG. 2 is a front view of a sheet of print media that has a toner bar, used for virtual stapling.

Referring now to FIG. 2, a sheet of print media is illustrated, generally designated by the reference numeral 100. Sheet 100 has been printed, basically in the form of a letter. For example, there is printed text in the form of paragraphs at 102, an address and greeting at 104, a salutation at 106, and a space for a signature at 108. This text 102, 104 and 106 is typically user-determined printed information. A substantially solid strip or bar of toner can also be placed in the area at the reference numeral 110. In this illustrated example, the toner bar 110 is placed near the leading edge of this sheet 100 as the sheet passes through the printer 10. On FIG. 2, the leading edge is designated at 114, while the trailing edge is designated at 116. The planar surface of the sheet 100 is illustrated at 112.

Sheet 100 can be passed through the printer 10, then sent to the duplexer 90, where the sheet 100 is flipped and sent back to the printer. The second side of the sheet can be printed, if desired, and sent back to the duplexer 90. The sheet 100 is flipped again, and sent back to the printer, where it is met by a second sheet 120 (see FIG. 3). At this time the second sheet 120 is a virgin sheet from one of the paper trays (e.g., input tray 30). Both sheets 100 and 120 are sent through the printing station 60 and fuser 68 at the same time, essentially as one sheet. The virgin sheet 120 can be imaged, if desired, and then both sheets 100 and 120 can be simultaneously fused at fuser 68. The first sheet 100 will become joined or affixed to the second sheet 120 wherever there is sufficient toner present between the two sheets. If the toner strip or bar 110 is sufficiently large, then the sheets will be fused together at that location; thus toner strip/bar 110 acts as a predetermined affixing area on the surface of sheet 100.

Figure 3:
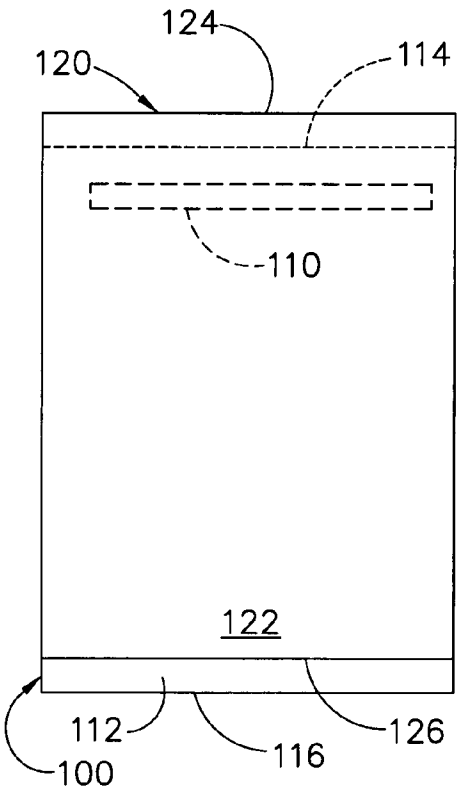
FIG. 3 is a front view of two sheets of print media that are being joined together by the toner bar of FIG. 2.

On FIG. 3, the second sheet 120 is on top (as seen in FIG. 3), and its leading edge 124 can be somewhat offset from the leading edge 114 of the first sheet 100 (in the sheet's longitudinal direction), if desired. The toner bar or strip 110 is shown on FIG. 3 in dashed lines (which is the toner bar between the two sheets 100 and 120). The planar surface of sheet 120 is illustrated at 122, and its trailing edge is at 126. As can be seen in FIG. 3, if sheets 100 and 120 are somewhat offset (in the sheet's longitudinal direction), then a portion of the surface 112 of the bottom sheet 100 is visible. Of course, if both sheets 100 and 120 are fed through the printing station and fuser such that their two leading edges 114 and 124 are substantially in alignment, then the second (bottom) sheet 100 will not have any of its surface 112 visible in a view such as that of FIG. 3.

Once the two sheets are fused together, they will simulate a stapled pair of sheets and can be handled without separation. While a typical staple application would require that the sheets are aligned, it is possible to staple the sheets in any type of shingled fashion, such as that illustrated in FIG. 3. This will allow the user to see the bottom (trailing) edge 116 of the underlying sheet 100, so it is possible to see at a glance that both sheets have been placed together as a single mechanical structure. Moreover, if the sheets are shingled such that they are offset to a greater extent (in the sheets' longitudinal direction), such as that illustrated in FIG. 4, then the user can see the bottom sheet such that it is possible to see at a glance that both sheets have been signed, for example.

Figure 4:
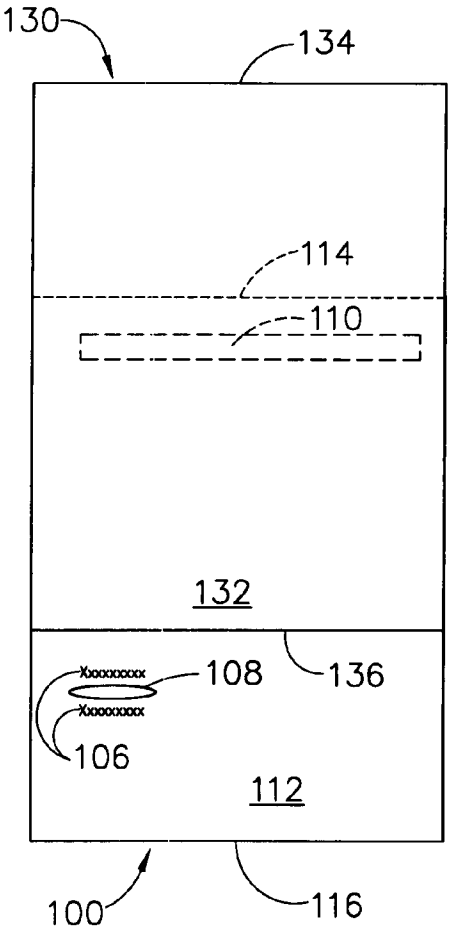
FIG. 4 is a front view of an alternative embodiment of two sheets of print media that are joined together by the toner bar of FIG. 2.

In FIG. 4, the bottom sheet 100 is offset by a much greater extent from a top sheet 130 (in the sheets' longitudinal direction). The top sheet 130 has a leading edge 134, a trailing edge 136, and a planar surface 132. The leading edge 114 of the bottom sheet 100 is virtually in the middle of the page (from top to bottom) of the top sheet 130. Therefore, the trailing edge 136 of the top sheet 130 ends up essentially in the middle of the first sheet 100 (from top to bottom), and the signature area 108 is visible in FIG. 4. The top or leading edge 134 of sheet 130 is visible in FIG. 4, and the "bar" of toner at 110 is located much farther down the page of the top sheet 130.

The printer's controller (including the processing unit 14) determines the amount of offset spacing (or time positioning in the paper path) between the trailing edge 116 of the first sheet 100 and the leading edge 124 of the second sheet 120 (see FIG. 3), as they enter the printing station 60 together. The printer's controller (including the processing unit 14) also determines the amount of offset spacing (or time positioning in the paper path) between the trailing edge 116 of the first sheet 100 and the leading edge 134 of the second sheet 130 (see FIG. 4), as they enter the printing station 60 together.

To avoid the need to circulate the first sheet 100 through the duplexer 90 more than one time to collate the two sheets that are to be stapled, the deflector 99 can be moved to its alternate position, so the first sheet 100 simply makes one pass beneath the printing station and is returned via the duplexer output path 98 to the input side of the printer without being flipped. This will speed up the process considerably, with regard to moving the first sheet back toward the printing station while the second sheet is being drawn from one of the paper trays.

The virtual stapler mode of the present invention has the ability to join or bind two or more sheets together in a printer, and as such it can save time, as well as save a post-processing unit that is available on many of the more expensive printers. It also avoids the possibility of manually stapling the wrong sheets together. Another advantage is that, once the sheets are bound together, if they are later taken apart there will be some evidence that the sheets were once bound, since the paper likely would be torn at the toner joint.

Another advantage of the virtual stapler mode of the present invention is that the resulting multiple sheets can be recycled, much like a sheet of paper having a high toner coverage. No removal of the mechanical staple (that would otherwise be involved) is necessary.

The joining or bond strength between the sheets can be customized, simply by increasing or decreasing the amount of toner used to create the joint/bond, or by varying the pattern of the virtual staple. Alternatively, the fuser pressure, fuser temperature, or process speed can be varied to either increase or decrease the bond or joining strength between the sheets.

A low tack bond or joint can be created by reducing the amount of toner in the toner bar or strip 110, if desired. This low tack joint/bond can then allow the sheets to be easily separated, if desired in a manner that is custom-designed to fit the customer's needs. This would allow the two joined sheets to be detached from each other without substantial tearing of the media.

Banner Printing from Cut Sheets

Figure 5:
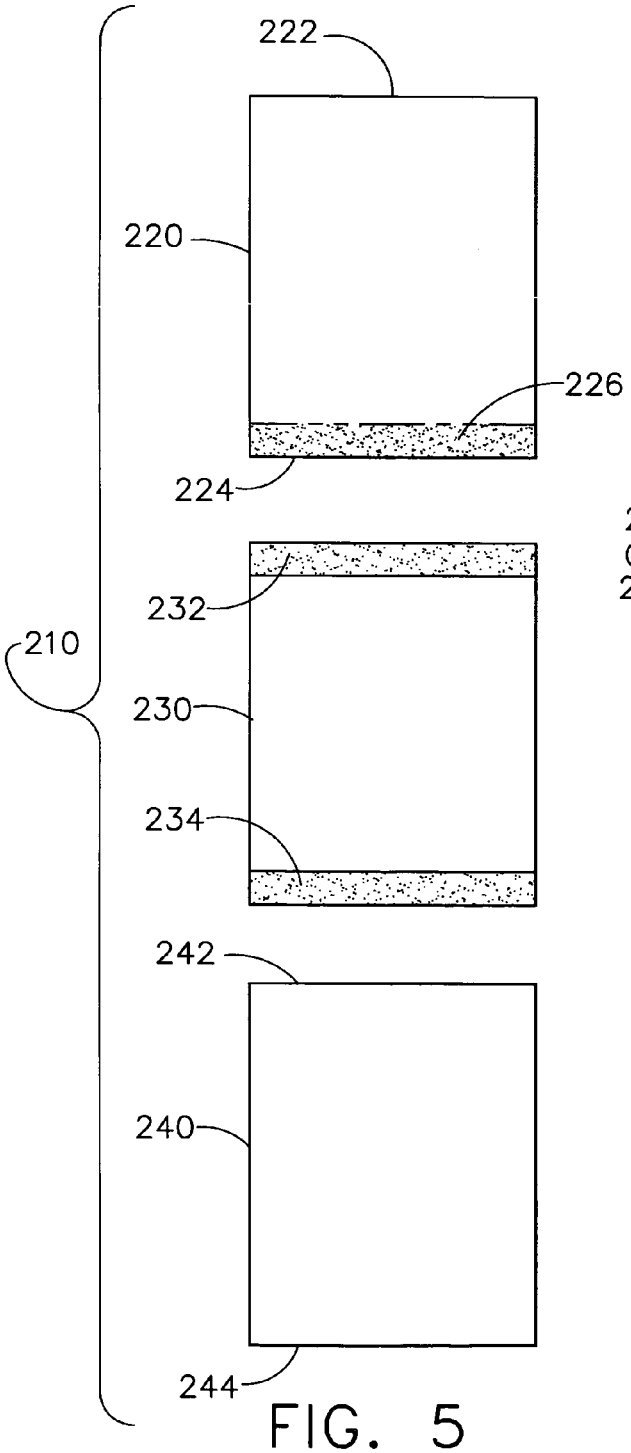
FIG. 5 is a front view of three sheets of print media before they are joined to create a banner.

Referring now to FIG. 5, a series of individual sheets of print media can be joined by using the principles of the present invention to create a substantially long sheet of paper, to thereby create a "banner." To perform this operation, printer 10 will print a first image on a first sheet of paper that is picked from one of the input trays. In FIG. 5, there are three separate sheets 220, 230, and 240 to begin with, which are generally referred to as a combination by the reference numeral 210.

In a first methodology of the present invention, the "first" sheet to be printed is the "middle" sheet 230. Sheet 230 may have predetermined image information that is placed on its surface by one or more of the color print engines. In addition, sheet 230 will be imaged so that it has a bar or strip of toner placed on it at 232, near its leading edge, and also a second bar or strip of toner placed at 234, near its trailing edge. Sheet 230, after passing through the printing station 60, is then directed to the duplexer 90 where it can be flipped and returned to the printing station, and then flipped again in a second operation through the printing station 60 and duplexer 90. Alternatively, the sheet 230 could be directed through a modified duplexer 90 that has the deflector 99, so that it need only pass through the duplexer once without being flipped.

Before the "first" sheet 230 is directed back toward the printing station 60, a "second" sheet 220 will be picked from one of the paper trays, and directed toward the printing station 60. Sheet 220 exhibits a leading edge 222 and a trailing edge 224 on FIG. 5, and a planar surface. Sheet 220 can be printed with predetermined image information on its planar surface when it arrives at the printing station 60. As it is being fed through the printing station, the "first" sheet 230 will be sent from the duplexer 90, so that a portion of the two sheets 220 and 230 overlap one another.

In this first method, the sheet 220 will then be positioned in time (i.e., in the paper pathway) so that it passes through the printing station 60 in a manner that overlays the toner strip 232 of sheet 230, and when they pass simultaneously through the fuser station at 68, these two sheets will be sealed together by that strip of toner 232. This is illustrated on FIG. 6, by the combination of the three sheets 250, in which the sheet 220 has a minimal overlap of the sheet 230, but this overlap is sufficient so that the entire toner bar 232 touches the sheet 220. The toner strip/bar 232 acts as a predetermined affixing areas on the surface of sheet 230—there is also a similar toner strip/bar 234, discussed below. (It should be noted that these strips/bars could instead have been placed on the surface of sheet 220 or sheet 240, if desired. An example of this type of alternative arrangement is described below.)

Figure 6:
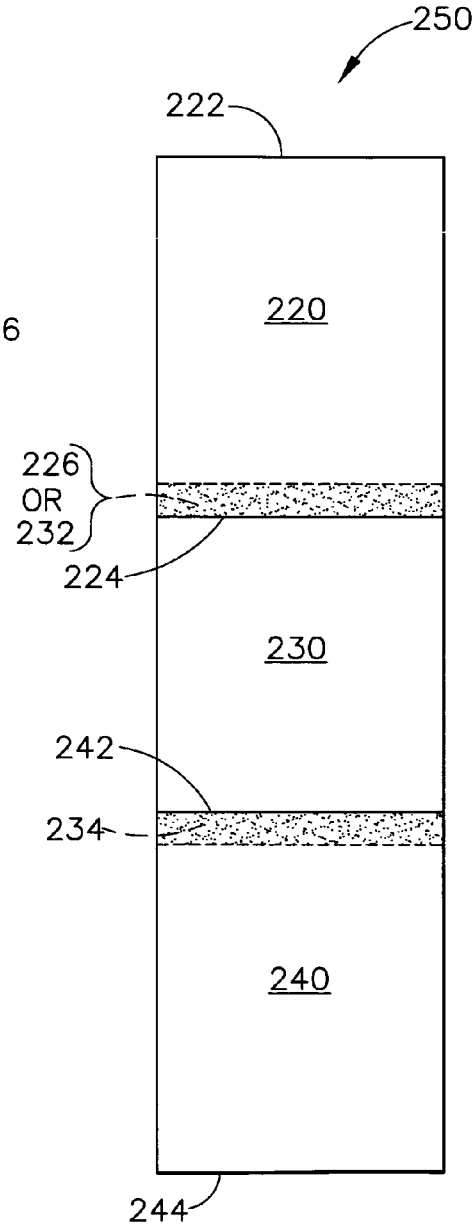
FIG. 6 is a front view of the three sheets of FIG. 4, which have been joined together to create a single lengthy banner.

The printer's controller (perhaps using the processing unit 14) determines the amount of offset spacing (or time positioning in the paper path) between the trailing edge 224 of the sheet 220 and the leading edge of the sheet 230, at toner strip 232, as they enter the printing station 60 together. As can be seen in FIG. 6, the final offset between sheets 220 and 230 is nearly the length of one of those two sheets (in the direction that the sheets travel through the paper pathways).

As the first two sheets 220 and 230 are passed through the printer, a third sheet 240 can be launched from one of the paper trays at a time so that its leading edge 242 can cover the second toner bar 234 with a sufficient amount of overlap. If desired, the "first" sheet 230 could be imaged during its first pass through the printer; and the "second" sheet 220 and "third" sheet 240 could be imaged during their pass through the printer. Or perhaps all three sheets 220, 230, and 240 could be imaged during this second pass through the printer, if desired. The system designer has flexibility in how and when the imaging will occur on the sheets of media that pass through the printing station 60 more than one time.

While all three sheets are passed together through the printing station and fuser, the first sheet 230 will be joined or affixed to the second sheet 220 by the toner bar 232, while the third sheet 240 is joined/affixed to the second sheet 230 by the toner bar 234. This toner bar 234 ends up being near the leading edge 242 of the third sheet 240. The final "banner" assembly 250 will have a combination leading edge 222 and a combination trailing edge 244, in which the trailing edge 244 is also the trailing edge of the third sheet 240. After the three sheets are fused together, the overall banner 250 is capable of being handled without separation.

It should be noted that the first sheet could be flipped only once by the duplexer 90, and then sent back toward the printing station 60, while a second sheet is being launched from the "above" or "top" tray 20. In the example printer of FIG. 1, the second sheet 220 would then face the toner bar 232 on sheet 230 (after sheet 230 was flipped once), and therefore, these two sheets would then fuse together at toner bar 232 (at an overlapping area) as they pass through the fuser 68. This in an alternative mode of using the first methodology of the invention, and is an example of one of the many possible variations that can be made to the embodiments described herein, which nevertheless fall within the principles of the present invention.

In a second methodology of the present invention, the "first" sheet to be printed is the "top" sheet 220. However, in this method, sheet 220 will be imaged so that it has a bar or strip of toner at 226 (illustrated in phantom lines on FIG. 5) placed on it near its trailing edge, during a first pass through the printing station 60. In this second method, the toner strip/bar 232 on sheet 230 will not be necessary.

Referring again to FIG. 5, the individual sheets of print media can be joined by using the second method to create a substantially long sheet of paper, or "banner." In this second method, printer 10 will print a first image on a first sheet of paper that is picked from one of the input trays, including the toner strip/bar 226. As noted above, the "first" sheet is now sheet 220. The first sheet 220 is then directed to the duplexer 90 where it can be flipped and returned to the printing station, and then flipped again in a second operation through the printing station 60 and duplexer 90. Alternatively, the sheet 220 could be directed through a modified duplexer 90 that has the deflector 99, so that it need only pass through the duplexer once without being flipped.

First sheet 220 exhibits a leading edge 222 and a trailing edge 224 on FIG. 5, and a planar surface. After first sheet 220 has been printed, it can be fed through the printing station at the same time a "second" sheet 230 is being directed therethrough. Sheet 230 will be imaged so that it has a bar or strip of toner placed on it at 234, near its trailing edge. The second sheet 230 will be positioned in time so that it passes through the printing station 60 in a manner that overlays the toner strip 226 of the first sheet 220, and when they pass simultaneously through the fuser station at 68, these two sheets will be sealed together by that strip of toner 226.

The controller (perhaps using the processing unit 14) determines the amount of offset spacing (or time positioning in the paper path) between the trailing edge 224 of the first sheet 220 and the leading edge of the second sheet 230, as they enter the printing station 60 together. As can be seen in FIG. 6, the final offset between sheets 220 and 230 is nearly the length of one of those two sheets (in the direction of the sheets' travel).

As the two sheet 220 and 230 pass together through the printing station 60, a second strip or bar of toner is placed on sheet 230 near its trailing edge, at 234. The combination of sheets 220 and 230 are then directed to the duplexer 90 where they can be flipped and returned to the printing station, and then flipped again in a second operation through the printing station 60 and duplexer 90. (It should be noted that a "typical" duplexer 90 would need to be modified so that it could handle a much longer media length which, in this example, would be almost twice the normal size of the initial sheet length.) Alternatively, the combined sheets 220 and 230 could be directed through a modified duplexer 90 that has the deflector 99, so that they need only pass through the duplexer once without being flipped. (In this latter circumstance, the longer combined sheet length would likely be less of a problem.)

The combined (and joined) sheets 220 and 230 are again directed toward the printing station 60. As the combined sheets 220 and 230 are passed through the printer, a third sheet 240 can be launched from one of the paper trays at a time so that its leading edge 242 can cover the second toner bar 234 with a sufficient amount of overlap. Sheet 240 can also be imaged by the print engine. If desired, the other two sheets 220 and 230 could be further imaged during this pass through the printer; or perhaps all three sheets 220, 230, and 240 could be imaged during this pass through the printer, if desired. Again, there is flexibility available to the system designer in this regard.

While all three sheets are passed together through the printing station and fuser, the first sheet 220 will remain joined or affixed to the second sheet 230 by the toner bar 226, while the third sheet 240 is joined/affixed to the second sheet 230 by the toner bar 234. This toner bar 234 ends up being near the leading edge 242 of the third sheet 240. The final "banner" assembly 250 will have a combination leading edge 222 and a combination trailing edge 244, in which the trailing edge 244 is also the trailing edge of the third sheet 240. After the three sheets are fused together, the overall banner 250 is capable of being handled without separation.

One advantage of the banner printing mode of the present invention is that multiple sheets can be used to increase the length of a typical sheet of print media by several fold. In the illustrated example, the three sheets were joined (or bonded) together to increase the length of the final output banner 250 to almost threefold. This can avoid the need to purchase substantially long "banner-sized" sheets. It also avoids the need to design a larger input tray to handle the longer banner-sized sheets. Another advantage is that the banner created using the present invention can be recycled, just like any sheet of paper that has high toner coverage.

A further advantage is that the sheet-to-sheet joint/bond strength can be customized by simply increasing or decreasing the amount of toner used to create the joint/bond, or by varying the pattern of the "virtual staple" used to create the fuser bars or strips 232 and 234 (or 226 and 234). Alternatively, the fuser pressure, fuser temperature, or the process speed can be varied, also to customize the joint/bond strength between the sheets.

Confidential Mailings

Figure 7:
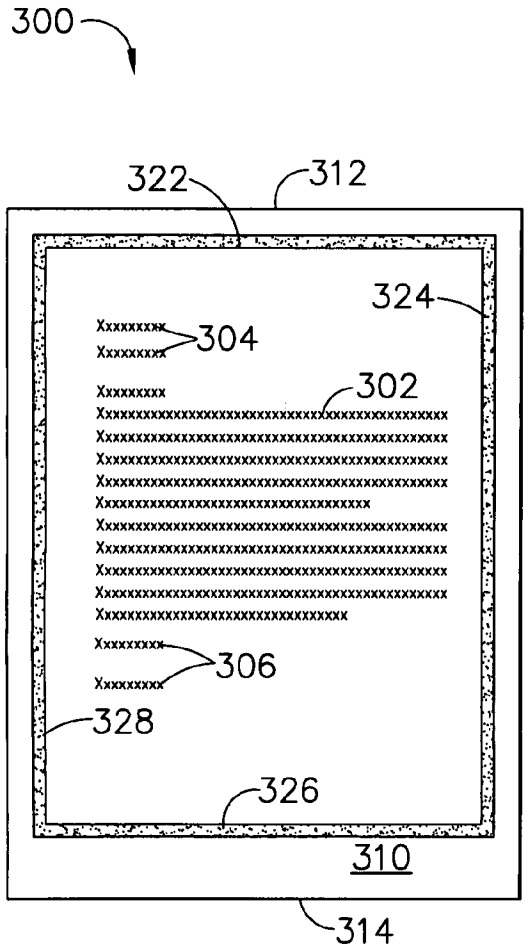
FIG. 7 is a front view of a sheet of print media that has a set of toner strips used for confidential papers.

Referring now to FIG. 7, a sheet of print media 300 is illustrated as having a leading edge 312, a trailing edge 314, a planar surface 310, and printed indicia at several places. In FIG. 7, the printed indicia has the appearance of a letter, including a body of text 302, a greeting and address 304, and a salutation at 306. This text 302, 304 and 306 is typically user-determined printed information.

The sheet 300 also includes several toner bars (or toner strips), at 322, 324, 326, and 328. This sheet 300 is fed through the printer 10, where it is imaged and printed at the printing station 60. It can be passed through a standard duplexer 90 two separate times to be flipped twice, or it can be passed through the alternative duplexer of the present invention by moving the deflector 99 to a position such that the sheet 300 will pass through only once and not be flipped.

When the sheet 300 is passed to the input pathway and toner transfer station 60 a second time, it will be met by a second, virgin sheet from one of the paper trays, and both sheets are fed through the printer simultaneously, as essentially one sheet. The virgin (second) sheet also can be imaged, if desired, at this time. Both sheets will be passed through the fuser 68 at the same time. The first sheet 300 will be fused to the second sheet wherever there is sufficient toner present, such as at the toner bars/strips 322, 324, 326, and 328. By using the toner bars illustrated in FIG. 7, a border is formed that will keep the information on the planar surface 310 confidential, because the second sheet will be permanently joined or affixed to the first sheet, until it is literally ripped off at the toner strip (or bar) locations. This effectively seals the confidential information inside the border formed by these toner bars/strips, thus providing a "security seal" around the confidential information, such that the area inside this border becomes a "security region" or "security area" that is predetermined by the print job data which forms these toner bars 322, 324, 326, and 328. This security region typically is a user-defined area, and can be substantially surrounded by the above-described toner bars/strips.

Figure 8:
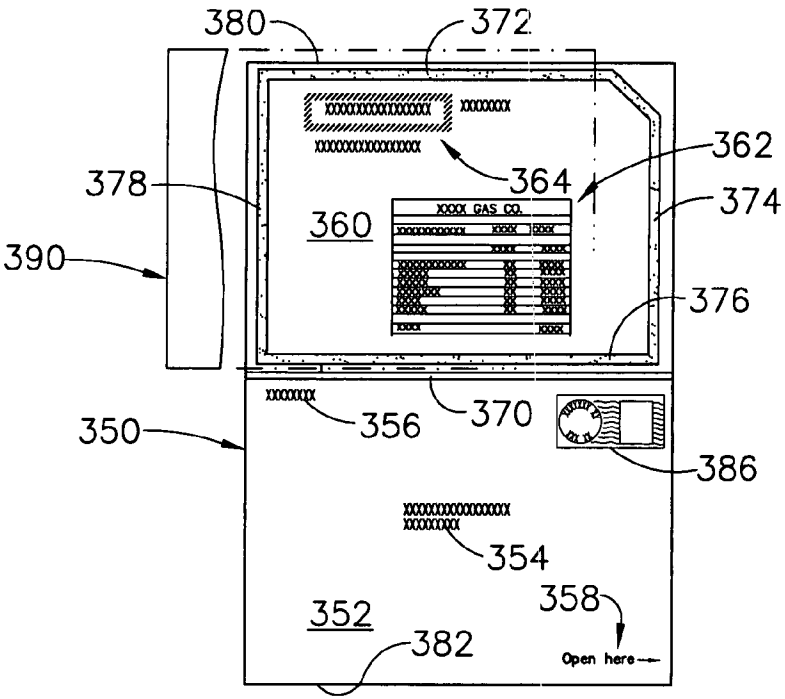
FIG. 8 is a front view of a first embodiment of a sheet of print media used for maintaining the confidentiality of a billing statement.

Referring now to FIG. 8, another sheet 350 of print media is illustrated as having been printed in the form of a typical A5 billing form. The sheet 350 has a leading edge 380 and a trailing edge 382, and other printed indicia in several places. This indicia includes a return address at 356, a mailing address at 354, which are both placed on the planar surface 352 of the sheet 350. There can also be an instruction that says "open here" at 358. Other printed indicia includes confidential information, which could include an address 364 and a billing statement 362, which are printed on the portion 360 of the planar surface of the sheet 350. This text or graphic information 362 and 364 is typically user-determined printed information.

There are several toner bars or strips in FIG. 8, namely at 372, 374, 376, and 378. These form a border that will be used to seal a second (smaller) sheet of media 390 to the first sheet 350, by passing the first sheet through the printer, duplexer 90, and back to the printing station 60, where it is met by the second sheet 390 that is picked from one of the input trays. When both sheets simultaneously pass through the fuser 68, the second sheet 390 will cover the top half of first sheet 350 at those toner bars/strips 372, 374, 376, and 378, thereby sealing in the confidential information in the billing statement at 362. These toner bars/strips effectively seal the confidential information inside the border formed thereby, thus providing a "security seal" around the confidential information, such that the area inside this border becomes a "security region" or "security area" that is predetermined by the print job data which forms these toner bars 372, 374, 376, and 378. This security region typically is a user-defined area, and can be substantially surrounded by the above-described toner bars/strips.

Figure 10:
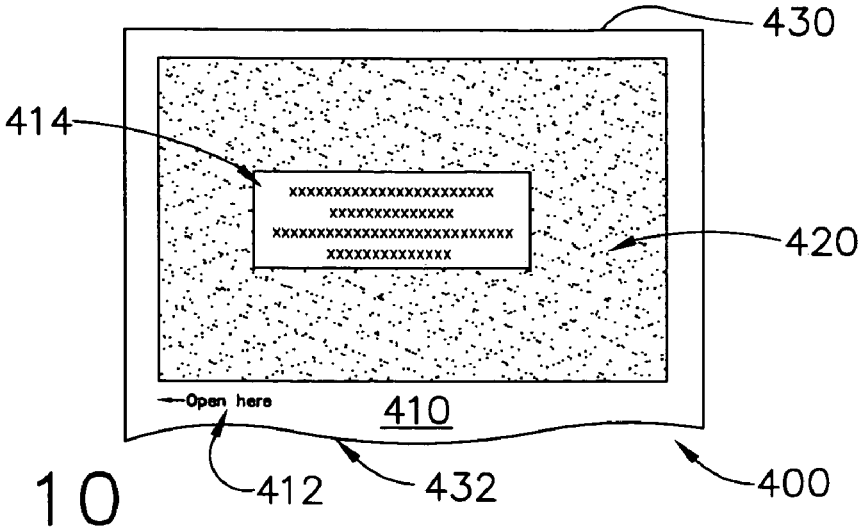
FIG. 10 is a front view of a second sheet of print media that has been pre-printed to help maintain or increase the confidentiality of information of a first sheet of print media joined thereto, such as the sheet of FIG. 7, FIG. 8, or FIG. 9.

Referring now to FIG. 10, a sheet 400 of media is illustrated as having a pattern of dots 420 that can be preprinted on sheet media 400 in one of the feed trays of the printer 10. This preprinted pattern 420 can then be used to cover certain information of a second sheet of media, in which that second sheet contains confidential information. The preprinted pattern 420 will help to hide that confidential information such that it will be much harder to read through any of the paper outer surfaces on the combined two sheets, after they are sealed together. In this manner, the sheet 400 essentially can act as the second sheet (390 on FIG. 8) that is joined to the "first sheet" 350 of FIG. 8. It should be noted that the pattern 420 need not necessarily be preprinted; such pattern could be printed in real time as the second sheet 400 is being processed through the printing station 60, and then applied to the first sheet 350.

This alternative second sheet 400 includes a leading edge 430, some printed information 414 within the preprinted pattern 420, and an instruction 412, such as "open here," all which is printed on the planar surface 410 of the sheet 400. If desired, this sheet 400 could be made to tear off along a line or area such as at 432 on FIG. 10. In this manner, the second sheet 400 could be used to only cover the top half of the "first sheet" 350, after they are joined together. Alternatively, the second sheet 400 could be a smaller piece of paper, such as having a length dimension that is only one-half of the length dimension of sheet 350. Or the second sheet 400 could be the same size as sheet 350, but the address information 354 and postage indicia 386 could be printed on top of the second sheet 400, as another alternative.

The toner strip/bars 372, 374, 376, and 378 act as predetermined affixing areas on the surface of sheet 350. As described above, they essentially form a seal around the confidential information in the area 362 of sheet 350, since a second sheet will be "sealed" against this first sheet 350 at those affixing areas.

Some of the advantages of this confidential mailing embodiment of the present invention is the ability to send confidential information without a time consuming burden of folding, stuffing, and sealing envelopes, as has been done in the past. Also, the printing can be such that it automatically addresses the envelopes, and the confidential information on the sealed sheet can be guaranteed to match the name of the confidential information on the envelope. The print quality can also be improved over that of a dot matrix printer. Furthermore, the postage can be printed, at a location 386 on FIG. 8. If desired as an alternative embodiment, the resulting mailer could be folded along a line 370, although that would likely increase the cost of handling the confidential mailer.

Typical uses for these types of statements are to send tax information, or for use as bank statements, utility statements, credit card PIN numbers, or other types of personalized advertisements. Another advantage of this confidential mailing embodiment is that there would be no need to stock envelopes, or to stock postage stamps.

An alternative embodiment for creating confidential mailings is depicted in FIG. 9, which again uses a second sheet 392 to cover a first sheet of print media 340, in which the sheet of media 340 can once again comprise a typical A5 billing form. The sheet 340 has a leading edge 380 and a trailing edge 382, and other printed indicia in several places. Such other printed indicia includes confidential information, which could include an address 364 and a billing statement 362, which are printed on the upper portion 360 of the planar surface 352 of the sheet 340. This text or graphic information 362 and 364 is typically user-determined printed information.

Figure 9:
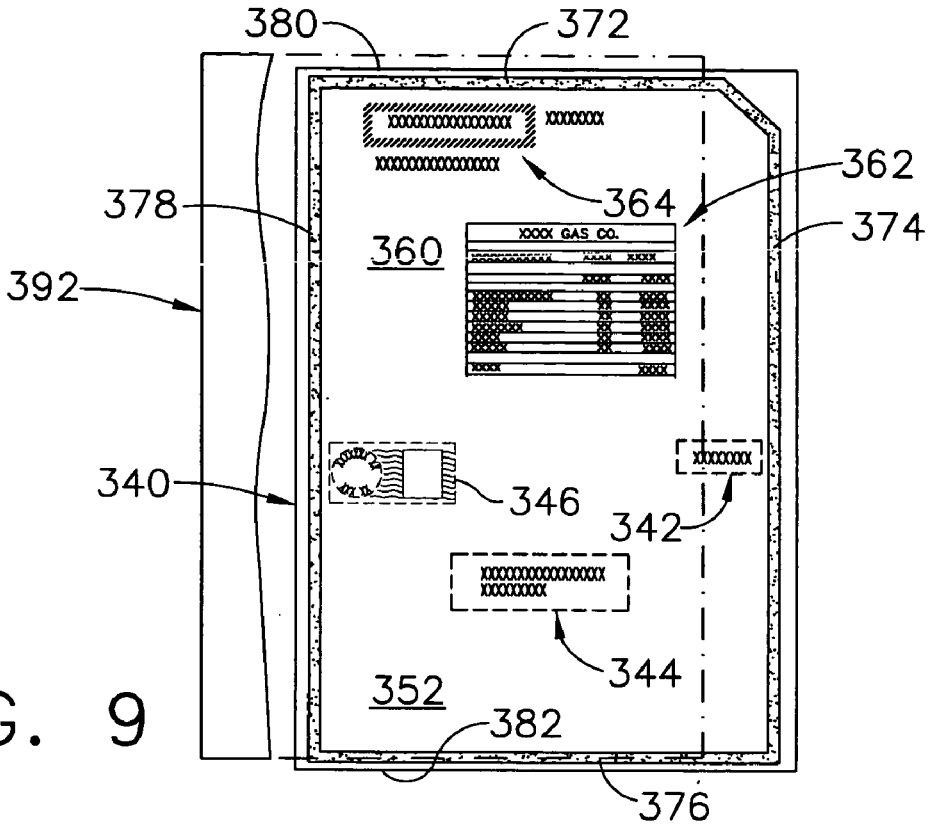
FIG. 9 is a front view of a second embodiment of a sheet of print media used for maintaining the confidentiality of a billing statement, in which some of the printed information is on the back side of the sheet.

There are several toner bars or strips in FIG. 9, namely at 372, 374, 376, and 378. These form a border that will be used to seal a second sheet of media 392 to the first sheet 340, by passing the first sheet through the printer, duplexer 90, and back to the printing station 60, where it is met by the second sheet 392 that is picked from one of the input trays. When both sheets simultaneously pass through the fuser 68, the second sheet 392 will cover the entire surface of first sheet 340 by becoming affixed to those toner bars/strips 372, 374, 376, and 378, thereby sealing in the confidential information in the billing statement at 362. These toner bars/strips effectively seal the confidential information inside the border formed thereby, thus providing a "security seal" around the confidential information, such that the area inside this border becomes a "security region" or "security area" that is predetermined by the print job data which forms these toner bars 372, 374, 376, and 378. This security region typically is a user-defined area, and can be substantially surrounded by the above-described toner bars/strips (in this instance, the entire surface of the sheet 340).

In this alternative embodiment, additional printed indicia may be printed on the reverse side of the sheet 340. For example, such reverse side indicia may include a return address at 342, a mailing address at 344, and postage at 346. This reverse side indicia will not be covered by the second sheet 392, and thus will be exposed so that the post office, for example, can see the address information and successfully mail the billing form. Since both sheets 340 and 392 are of the same size (e.g., A5), this second, alternative embodiment may be more useful than the embodiment illustrated in FIG. 8.

The second sheet 392 can also be printed with dots or other pattern indicia, such as the area 420 of the form 400 depicted in FIG. 10. In this alternative embodiment, the entire surface area 410 could contain the printed pattern 420, if desired. It should be noted that the pattern 420 need not necessarily be preprinted; such pattern could be printed in real time as the second sheet 400 is being processed through the printing station 60, and then applied to the first sheet 340.

It will be understood that the term "print media" herein refers to a sheet or roll of material that has toner or some other "printable" material applied thereto by a print engine, such as that found in a laser printer, or other type of electrophotographic printer. Alternatively, the print media represents a sheet or roll of material that has ink or some other "printable" material applied thereto by a print engine or printhead, such as that found in an ink jet printer, or which is applied by another type of printing apparatus that projects a solid or liquified substance of one or more colors from nozzles or the like onto the sheet or roll of material; although for the present invention, such printable material would need to have some adhesive characteristics with respect to joining (adhering or bonding) two sheets of print media together. Print media is sometimes referred to as "print medium," and both terms have the same meaning with regard to the present invention, although the term print media is typically used in this patent document. Print media can represent a sheet or roll of plain paper, bond paper, transparent film (often used to make overhead slides, for example), or any other type of printable sheet or roll material. The term "sheet media" specifically refers to sheets of print media, as opposed to a continuous roll of print media.

It will also be understood that the logical operations used in the present invention to control the movements of the sheet media and the toner placement on the sheet media can be implemented using sequential logic, such as by using microprocessor technology, or using a logic state machine, or perhaps by discrete logic; it even could be implemented using parallel processors. One preferred embodiment may use a microprocessor or microcontroller (e.g., microprocessor 14) to execute software instructions that are stored in memory cells within an ASIC. In fact, the entire microprocessor 14 along with dynamic RAM and executable ROM may be contained within a single ASIC. Of course, other types of circuitry could be used to implement these logical operations depicted in the drawings without departing from the principles of the present invention. It should be noted that a portion, or perhaps all, of the control logic for the present invention could be implemented on a control device that is physically remote from the printer itself, such as logic in a host computer, for example, or in a print server (on a network). Such situations are contemplated by the inventors and are part of the present invention.

It will be further understood that the material used to join (bond or adhere) two or more sheets of print media together in the present invention can comprise standard laser printer toner, or can be a different substance that has a quality for adhering to such print media after being run through a fusing station of an EP printer. It would be preferred for the joining/bonding material (e.g., toner) to have a characteristic of being able to harden (in a fuser, for example), and then later be resoftened or reactivated by the fuser a second time. It also would be desirable for the joining/bonding material (e.g., toner) to have a fairly strong affinity to adhere to the sheet media in a fairly predictable manner, so that the size and dot density of a toner strip can be predetermined with respect to the desired strength of the final joint or bond between the two sheets of print media. In some cases, it will be desired for the fabric of the sheet media to literally rip or tear before it could be possibly separated from the toner strips; a liberal amount of toner material within a "large" toner strip can guarantee this result.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A method for printing and joining at least two sheets of print media in an image forming apparatus, said method comprising:

(a) providing an image forming apparatus having a print media input device, a print engine that applies and affixes image-forming material to said print media at an image-forming station and at an image-fixing station, a first output pathway that re-directs said print media back to said print engine, and a second output pathway that directs said print media to an output area;

(b) moving a first sheet of said print media from said print media input device to said print engine, and, according to user print data, applying said image-forming material to a first surface of said first sheet at said image-forming station, including to at least one predetermined affixing area of said first surface of the first sheet;

(c) moving said first sheet through said first output pathway, and back to said print engine;

(d) moving a second sheet of said print media from said print media input device to said print engine in a manner such that said second sheet overlaps at least a portion of said first sheet, said portion including said at least one predetermined affixing area, wherein said first surface of the first sheet is facing toward said second sheet;

(e) at said image-fixing station, joining both said first sheet and said second sheet to said image-forming material at said at least one predetermined affixing area, thereby joining said first and second sheets together as combined sheets of print media; and (f) thereafter, moving said combined sheets of print media through said second output pathway to said output area.

2. The method as recited in claim 1, wherein said image-fixing station comprises a fuser that applies sufficient thermal energy to said image-forming material so that it melts and adheres to both the second sheet and said first surface of the first sheet within said at least one predetermined affixing area.

3. The method as recited in claim 2, wherein said fuser comprises a hot roller and a backup roller to form a nip through which said first and second sheets pass, and fixes substantially all image-forming material that was applied to said first surface of the first sheet, but only fixes substantially the portion of said image-forming material that is located within said at least one predetermined affixing area to said second sheet.

4. The method as recited in claim 1, wherein: (a) said at least one predetermined affixing area is proximal to a trailing edge of said first sheet and proximal to a leading edge of said second sheet; (b) the timing of movement of said second sheet is controlled such that the second sheet overlaps said first sheet just enough so that the portion of said first sheet that is covered by said second sheet is essentially the same area as said at least one predetermined affixing area; and (c) when they enter said output area, said combined sheets comprise a banner shape that exhibits a length dimension that is almost twice the length of a single one of said first and second sheets.

5. The method as recited in claim 1, wherein: said at least one predetermined affixing area of said first surface of the first sheet comprises a plurality of toner strips that substantially surround a user-defined area containing user-determined printed information on said first surface of the first sheet; and when said second sheet is joined to said first sheet to create said combined sheets of print media, said user-defined area is substantially sealed by said plurality of toner strips such that said user-determined printed information is substantially protected from being viewed while said second sheet remains attached to said first sheet.

6. The method as recited in claim 5, wherein said user-determined printed information includes: (a) confidential information within said user-defined area, and (b) address information and postage indicia outside of said user-defined area.

7. The method as recited in claim 6, wherein said confidential information is printed on said first surface of said first sheet, and said address information and postage indicia is printed on a second, opposite surface of said first sheet.

8. The method as recited in claim 5, wherein said second sheet includes patterned indicia on an inner surface of said second sheet, said indicia being positioned at predetermined locations that are placed over said confidential information to aid in preventing said confidential information from being viewed through said second sheet.

9. The method as recited in claim 1, wherein a processing circuit controls said moving, applying, and joining steps, and a memory circuit stores data used by said processing circuit; and wherein said processing circuit is physically located at one of: (a) said image forming apparatus, and (b) a separate computing apparatus.

10. A method for printing and joining at least three sheets of print media in an image forming apparatus, said method comprising:

(a) providing an image forming apparatus having a print media input device, a print engine that applies and affixes image-forming material to said print media at an image-forming station and at an image-fixing station, a first output pathway that re-directs said print media back to said print engine, and a second output pathway that directs said print media to an output area;

(b) moving a first sheet of said print media from said print media input device to said print engine, and, if called for by user print data, applying said image-forming material to a surface of said first sheet at said image-forming station;

(c) moving said first sheet through said first output pathway, and back to said print engine;

(d) moving a second sheet of said print media from said print media input device to said print engine in a manner such that said second sheet overlaps at least a portion of said first sheet at a first predetermined affixing area, and, if called for by user print data, applying said image-forming material to a surface of said second sheet at said image-forming station;

(e) wherein, said user print data includes applying said image-forming material to at least one of said surfaces of the first and second sheets within said first predetermined affixing area, and at said image-fixing station, joining both said first sheet and said second sheet to said image-forming material at said first predetermined affixing area, thereby joining said first and second sheets together as a first set of combined sheets of print media;

(f) thereafter, moving said first set of combined sheets of print media through said first output pathway and back to said print engine;

(g) moving a third sheet of said print media from said print media input device to said print engine in a manner such that said third sheet overlaps at least a portion of said first set of combined sheets at a second predetermined affixing area, and, if called for by user print data, applying said image-forming material to a surface of said third sheet at said image-forming station;

(h) wherein, said user print data includes applying said image-forming material to at least one of said surfaces of the second and third sheets within said second predetermined affixing area, and at said image-fixing station, joining both said second sheet and said third sheet to said image-forming material at said second predetermined affixing area, thereby joining said second and third sheets together as a second set of combined sheets of print media, which now includes all of said first, second, and third sheets; and (i) thereafter, moving said second set of combined sheets of print media through one of: (i) said first output pathway and back to said print engine, and (ii) said second output pathway to said output area.

11. The method as recited in claim 10, wherein: (a) said user print data includes information that is affixed to at least one of the surfaces of said first, second, and third sheets by said image-fixing station; (b) thereafter, moving said second set of combined sheets of print media through said second output pathway to said output area; and (c) when entering said output area, said second set of combined sheets comprises a banner shape that exhibits a length dimension that is almost three times the length of a single one of said first, second, and third sheets.

12. The method as recited in claim 10, further comprising the steps of: (a) after moving said second set of combined sheets of print media through said first output pathway and back to said print engine, moving said second set of combined sheets of print media to said print engine, and, if called for by user print data, applying and affixing said image-forming material to at least one of the surfaces of said first, second, and third sheets at said image-forming station and said image-fixing station; (b) thereafter, moving said second set of combined sheets of print media through said second output pathway to said output area; and (c) when entering said output area, said second set of combined sheets comprises a banner shape that exhibits a length dimension that is almost three times the length of a single one of said first, second, and third sheets.

13. The method as recited in claim 10, wherein said image-fixing station comprises a fuser that applies sufficient thermal energy to said image-forming material so that it melts and adheres to both said first and second sheets within said first predetermined affixing area.

14. The method as recited in claim 13, wherein said fuser comprises a hot roller and a backup roller to form a nip through which said first and second sheets pass, and fixes substantially all image-forming material that was applied to said surface of the first sheet, but only fixes substantially the portion of said image-forming material that is located within said at least one predetermined affixing area to said second sheet.

15. The method as recited in claim 10, wherein a processing circuit controls said moving, applying, and joining steps, and a memory circuit stores data used by said processing circuit; and wherein said processing circuit is physically located at one of: (a) said image forming apparatus, and (b) a separate computing apparatus.

16. A method for printing and joining at least three sheets of print media in an image forming apparatus, said method comprising:

(a) providing an image forming apparatus having a print media input device, a print engine that applies and affixes image-forming material to said print media at an image-forming station and at an image-fixing station, a first output pathway that re-directs said print media back to said print engine, and a second output pathway that directs said print media to an output area;

(b) moving a first sheet of said print media from said print media input device to said print engine, and, if called for by user print data, applying said image-forming material to a surface of said first sheet at said image-forming station;

(c) moving said first sheet through said first output pathway, and back to said print engine;

(d) moving a second sheet of said print media from said print media input device to said print engine in a manner such that said second sheet precedes said first sheet at said print engine and overlaps at least a portion of said first sheet at a first predetermined affixing area, and, if called for by user print data, applying said image-forming material to a surface of said second sheet at said image-forming station;

(e) moving a third sheet of said print media from said print media input device to said print engine in a manner such that said third sheet follows said first sheet at said print engine and overlaps at least a portion of said first sheet at a second predetermined affixing area, and, if called for by user print data, applying said image-forming material to a surface of said third sheet at said image-forming station;

(f) wherein, said user print data includes applying said image-forming material to at least one of said surfaces of the first and second sheets within said first predetermined affixing area, and at said image-fixing station, joining both said first sheet and said second sheet to said image-forming material at said first predetermined affixing area, thereby joining said first and second sheets together as a first set of combined sheets of print media;

(g) wherein, said user print data includes applying said image-forming material to at least one of said surfaces of the first and third sheets within said second predetermined affixing area, and at said image-fixing station, joining both said first sheet and said third sheet to said image-forming material at said second predetermined affixing area, thereby joining said first and third sheets together as a second set of combined sheets of print media, which now includes all of said first, second, and third sheets; and (i) thereafter, moving said second set of combined sheets of print media through one of: (i) said first output pathway and back to said print engine, and (ii) said second output pathway to said output area.

17. The method as recited in claim 16, wherein: (a) said user print data includes information that is affixed to at least one of the surfaces of said first, second, and third sheets by said image-fixing station; (b) thereafter, moving said second set of combined sheets of print media through said second output pathway to said output area; and (c) when entering said output area, said second set of combined sheets comprises a banner shape that exhibits a length dimension that is almost three times the length of a single one of said first, second, and third sheets.

18. The method as recited in claim 16, further comprising the steps of: (a) after moving said second set of combined sheets of print media through said first output pathway and back to said print engine, moving said second set of combined sheets of print media to said print engine, and, if called for by user print data, applying and affixing said image-forming material to at least one of the surfaces of said first, second, and third sheets at said image-forming station and said image-fixing station; (b) thereafter, moving said second set of combined sheets of print media through said second output pathway to said output area; and (c) when entering said output area, said second set of combined sheets comprises a banner shape that exhibits a length dimension that is almost three times the length of a single one of said first, second, and third sheets.

19. The method as recited in claim 16, wherein said image-fixing station comprises a fuser that applies sufficient thermal energy to said image-forming material so that it melts and adheres to both said first and second sheets within said first predetermined affixing area.

20. The method as recited in claim 19, wherein said fuser comprises a hot roller and a backup roller to form a nip through which said first and second sheets pass, and fixes substantially all image-forming material that was applied to said first surface of the first sheet, but only fixes substantially the portion of said image-forming material that is located within said at least one predetermined affixing area to said second sheet.

21. The method as recited in claim 16, wherein a processing circuit controls said moving, applying, and joining steps, and a memory circuit stores data used by said processing circuit; and wherein said processing circuit is physically located at one of: (a) said image forming apparatus, and (b) a separate computing apparatus.

22. A method for printing and joining two sheets of print media in an image forming apparatus, said method comprising:

(a) providing an image forming apparatus having a print media input device, a print engine that applies and affixes image-forming material to said print media at an image-forming station and at an image-fixing station, a first output pathway that re-directs said print media back to said print engine, and a second output pathway that directs said print media to an output area;

(b) moving a first sheet of said print media from said print media input device to said print engine, and, according to user print data, applying and affixing said image-forming material to a first surface of said first sheet at said image-forming and image-fixing stations, said user print data including a plurality of predetermined security regions;

(c) moving said first sheet through said first output pathway, and back to said print engine;

(d) moving a second sheet of said print media from said print media input device to said print engine in a manner such that said second sheet overlaps at least a portion of said first sheet, wherein said first surface of the first sheet is facing toward said second sheet;

(e) at said image-fixing station, joining both said first sheet and said second sheet to said image-forming material to create security seals at said plurality of predetermined security regions, thereby joining said first and second sheets together as combined sheets of print media; and (f) thereafter, moving said combined sheets of print media through said second output pathway to said output area, thereby producing a document having printed information that is sealed from view, without any folding operation and with no separate heated platen apparatus.

23. The method as recited in claim 22, wherein said plurality of predetermined security regions comprise toner strips of a user-defined toner density, length, width, and position on the first surface of said first sheet.

24. The method as recited in claim 22, wherein said user-determined printed information includes (a) confidential information placed in an area within said predetermined security regions, and (b) address information and postage indicia outside of said area within said predetermined security regions.

25. The method as recited in claim 24, wherein said confidential information is printed on said first surface of said first sheet, and said address information and postage indicia is printed on a second, opposite surface of said first sheet.

26. The method as recited in claim 24, wherein said second sheet includes patterned indicia on the inner surface of said second sheet, said indicia being positioned at predetermined locations that are placed over said confidential information to aid in preventing said confidential information from being viewed through said second sheet.

27. The method as recited in claim 22, wherein said user-determined printed information includes: (a) confidential information placed on said first sheet in an area within said predetermined security regions, and (b) address information and postage indicia, placed on said second sheet outside of said area within said predetermined security regions.

28. The method as recited in claim 22, wherein a processing circuit controls said moving, applying, and joining steps, and a memory circuit stores data used by said processing circuit; and wherein said processing circuit is physically located at one of: (a) said image forming apparatus, and (b) a separate computing apparatus.

29. An image forming apparatus, comprising:

an interface circuit; a print media input device, a print engine that applies and affixes image-forming material to said print media at an image-forming station and at an image-fixing station, a first output pathway that re-directs said print media back to said print engine, and a second output pathway that directs said print media to an output area; wherein:

said interface circuit contains input and output devices that are configured: (a) to move a first sheet of print media from said print media input device to said print engine, and, according to user print data, to apply said image-forming material to a first surface of said first sheet at said image-forming station, including to at least one predetermined affixing area of said first surface of the first sheet; (b) to move said first sheet through said first output pathway, and back to said print engine; (c) to move a second sheet of said print media from said print media input device to said print engine in a manner such that said second sheet overlaps at least a portion of said first sheet, said portion including said at least one predetermined affixing area, wherein said first surface of the first sheet is facing toward said second sheet, and to determine a relative position of a leading edge of said first sheet compared to a leading edge of said second sheet as they move through said print engine; (d) at said image-fixing station, to join both said first sheet and said second sheet to said image-forming material at said at least one predetermined affixing area, thereby joining said first and second sheets together as combined sheets of print media; and (e) thereafter, to move said combined sheets of print media through said second output pathway to said output area.

30. The image forming apparatus as recited in claim 29, further comprising a duplexer that receives said print media from said print engine by way of said first output pathway, said duplexer including includes a movable deflector: (a) that in a first position causes said sheet media to be flipped to its opposite side before continuing back to said print engine, and (b) that in a second position causes said sheet media to pass through said duplexer without being flipped before continuing back to said print engine.

31. The image forming apparatus as recited in claim 29, further comprising: a processing circuit that controls signals to and from said interface circuit, and a memory circuit that stores data used by said processing circuit; and wherein said processing circuit is physically located at one of: (a) said image forming apparatus, and (b) a separate computing apparatus.

32. The image forming apparatus as recited in claim 29, wherein said image-fixing station comprises a fuser that applies sufficient thermal energy to said image-forming material so that it melts and adheres to both the second sheet and said first surface of the first sheet within said at least one predetermined affixing area.

33. The image forming apparatus as recited in claim 32, wherein said fuser comprises a hot roller and a backup roller to form a nip through which said first and second sheets pass, and fixes all image-forming material that was applied to said first surface of the first sheet, but only fixes the portion of said image-forming material that is located within said at least one predetermined affixing area to said second sheet.

34. The image forming apparatus as recited in claim 29, wherein when said interface circuit determines a relative position of a leading edge of said first sheet compared to a leading edge of said second sheet, it determines whether said second sheet is to be placed with said first sheet in one of: (a) a partial overlapping position, and (b) a full overlapping position.

35. The image forming apparatus as recited in claim 29, wherein said at least one predetermined affixing area comprises at least one toner strip.

* * * * *